US005516613A

United States Patent [19]

Asanae et al.

[11] Patent Number: 5,516,613

[45] Date of Patent: May 14, 1996

[54] BINARY DEVELOPER

[75] Inventors: Masumi Asanae, Kumagaya; Masahisa Ochiai, Fukaya; Tsutomu Saitoh, Kumagaya, all of Japan

[73] Assignee: Hitachi Metals, Ltd., Japan

[21] Appl. No.: 352,721

[22] Filed: Dec. 2, 1994

[30] Foreign Application Priority Data

Dec. 3, 1993 [JP] Japan ..... 5-303683

[51] Int. Cl.[6] ..... G03G 9/083

[52] U.S. Cl. ..... 430/106.6; 430/108

[58] Field of Search ..... 430/108, 106.6

[56] References Cited

U.S. PATENT DOCUMENTS 4,816,364 3/1989 Oishi et al. ..... 430/106.6
5,158,852 10/1992 Sakata et al. ..... 430/106.6
5,340,677 8/1994 Baba et al. ..... 430/106.6

FOREIGN PATENT DOCUMENTS 59-162563 9/1984 Japan .
3-163569 7/1991 Japan .

*Primary Examiner*—John Goodrow
*Attorney, Agent, or Firm*—Finnegan, Henderson, Farabow, Garrett & Dunner

[57] ABSTRACT

A binary developer is composed of a carrier and a magnetic toner. The carrier consists of nonspherically formed magnetic particles having an average diameter of 5 to 100 μm, preferably 5 to 50 μm. The magnetic toner is formed to have an average particle diameter of 10 μm or less and a saturated magnetization $\sigma_s$ of 50 emu/g or less.

5 Claims, 2 Drawing Sheets

BINARY DEVELOPER

BACKGROUND OF THE INVENTION

1. Field of the Invention

This invention relates to a developer for developing electrostatic latent image used in electrophotographic copying machine, a printer and a facsimile machine, and, in particular, to a binary developer composed of a carrier consisting of magnetic particles having a small diameter and a magnetic toner.

2. Description of the Prior Art

In conventional printers and facsimile machines etc. using electro-photography, an electrostatic latent image corresponding to information is formed, for example, on a cylindrical photosensitive drum, a magnetic developer is attracted on and conveyed by a developing roller consisting of a non-magnetic sleeve and a permanent magnet member inside the sleeve facing the photosensitive drum to form a magnetic brush in the developing region, and the surface of the photosensitive drum on which the electrostatic latent image is formed is rubbed with the magnetic brush to produce a visible image as a toner image. In the most general method, the image is thermally fixed after the visible toner image is transferred on to a recording member (for example plain paper).

In this case, since a small amount of toner remains on the photosensitive drum, the image medium, even after the toner image is transferred onto the recording paper, a cleaning device is usually provided for removing the remaining toner. Therefore, on the one hand, a problem arises in that a space for the above cleaning device is required in the vicinity of the photosensitive drum, interfering with attempts to reduce the size of the imaging equipment as a whole.

On the other hand, an example of the method for downsizing the imaging equipment as a whole is the omission of the above cleaning device and the provision of a so-called developer cleaning device, which recovers toner remaining on the photosensitive drum and develops the electrostatic latent image at the same time in a region where the photosensitive drum and the developing roller face each other (see, e.g., PUPA 4-86878). In imaging equipment without this cleaning device, a magnetic developer consisting of the mixture of a toner and a spherical magnetic carrier is used.

When a spherical magnetic carrier is used as described above, however, since the specific surface area of the magnetic carrier is small, the area contacting the toner is inevitably small, causing problems in that the tribo-electric charge of the toner is small, the image density is low, and sharp images cannot be produced.

If the particle diameter of the magnetic carrier is reduced for forming finer images, even though a thin developer layer is formed and high-resolution, high-quality images are obtained, there still remain such problems in that the ability of the developing means to magnetically hold the magnetic carrier causes the increased scattering of the carrier, the vicinity of the developing means is contaminated, and the image quality deteriorates due to the adhesion of the carrier on to the photosensitive drum.

Since the magnetic toner composing the binary developer as described above contains magnetic powder, the magnetic toner on the image produced on the photosensitive drum moves easily due to the revolution of the developing roller, causing the problem of tailing which lowers the image quality.

Furthermore, when a developer cleaning device, which recovers the toner and develops the electrostatic latent image at the same time, is used for developing an image with each revolution of the drum, if the toner, after the toner image is transferred onto the recording paper, remains on the photosensitive drum, the remaining toner cannot be recovered completely by the developer cleaning section, and may adhere to and remain on the electrostatic latent image formation section even after developing.

If the remaining toner has not been recovered completely, the quality of the image obtained significantly deteriorates. In order to solve such problems, a method for developing an image with each two revolutions of the photosensitive drum may be used to recover the remaining toner as described above completely but, in such a system, the speed of image production is inevitably lowered, and the requirement for quick information transmission may not be met.

SUMMARY OF THE INVENTION

It is the object of the present invention to solve such problems of the prior art, and to provide a binary developer for developing electrostatic latent images which develops high-quality images, enables the remaining toner on the surface of the image medium to be recovered completely, and reduces the size of the equipment as a whole.

In order to achieve the above object, the present invention uses a technical means in which a carrier consisting of nonspherical magnetic particles formed having an average diameter of 5 to 100 μm, preferably 5 to 50 μm, and a magnetic toner formed having an average diameter of 10 μm or less with a saturation magnetization ($\sigma_s$) of 50 emu/g are mixed.

The above magnetic toner is preferably formed having a intrinsic coercive force (iHc) of 50 Oe. In the present invention, on the one hand, if the average diameter of the magnetic particles is small, the carrier scatters and is deposited on the surface of the image medium, degrading the quality of images. On the other hand, if the particle diameter is large, rough images are produced. Therefore, the average diameter of the magnetic particles should be 5 to 100 μm, preferably 5 to 50 μm.

The magnetic particles described above may be any of the iron powders such as pulverized iron powder, and reduced iron powder, ferrite powders (Ni—Zn system, Mn—Zn system, Mg—Zn system, Cu—Zn system, etc.), magnetite or particles in which magnetic powder dispersed in a resin matrix and so on. The shape of the particles is preferably nonspherical, such as polyhedral, polygonal, scaly, flat or flake-like, or amorphous to increase the specific surface area. In order to prevent the carrier from being deposited on the surface of the photosensitive material, the saturation magnetization $\sigma_s$ of the magnetic particles composing the carrier is preferably 60 emu/g or higher.

The carrier for the developer of the present invention may consist of the above magnetic particles coated with a resin material for improving durability, adjusting resistance, and controlling the tribo-electric charge of the toner. Such resin materials include the homopolymers or copolymers of styrenes such as p-chlorostyrene and methyl styrene; halogenated vinyl compounds such as vinyl chloride, vinyl bromide, and vinyl fluoride; vinyl esters such as vinyl acetate, vinyl propionate, vinyl benzoate, and vinyl acetate; the esters of α-methylene aliphatic monocarboxylic acids such as methyl acrylate, ethyl acrylate, butyl acrylate, isobutyl acrylate, dodecyl acrylate, n-octyl acrylate, 3-chloroethyl acrylate, phenyl acrylate, methyl α-chloroacrylate, and butyl methacrylate; vinyl ethers such as acrylonitrile, methacrylonitrile, acrylamide, vinylmethyl ether, vinylisobutyl ether, and vinylmethyl ether; and vinyl ketones such as vinylethyl ketone, vinylhexyl ketone, and methylisopropenyl ketone. Other resins such as epoxy resins, silicone resins, rosin-modified phenol-formaldehyde resins, cellulose resin, polyether resins, polyvinyl butylal resins, polyester resins, styrene-butadiene resins, polyurethane resins, polycarbonate resins, and fluorinated resins such as 4-fluoroethylene may also be used individually or in a combination thereof.

Especially useful among these resins are styrene-acrylic resins, silicone resins, epoxy resins, styrene-butadiene resins, and cellulose resins.

The above coated carriers may be formed, for example, as follows: A resin is dissolved in a solvent such as benzene, toluene, xylene, methylethyl ketone, tetrahydrofurane, chloroform, or hexane. The resin may be used as an emulsion. The solution or emulsion of the resin is sprayed so as to uniformly coat the surface of the magnetic particles. In order to coat the surface uniformly, it is preferable to maintain the magnetic particles in a flowing state. For this purpose, the use of a spray dryer or a fluidizing bed is preferred. The resin solution is sprayed at about 200° C. or below, preferably about 100° to 150° C., to remove the solvent promptly. During this processing step, the resin coating is dried. When a resin emulsion is used, the emulsion is sprayed at a temperature from room temperature to 100° C. to melt and adhere the resin onto the surface of the magnetic particles.

The average volume diameter of the magnetic toner exceeding 10 μm is not preferred, because resolution is lowered and the current requirement for the development of high-quality images of 400 DPI or higher cannot be met. If the average diameter is too small, however, scattering of the toner occurs easily; therefore, the average diameter is preferably 3 μm or more.

Saturated magnetization ($\sigma_s$) of the magnetic toner exceeding 50 emu/g is also not preferred because the magnetic toner on the image produced on the image medium will move easily due to the revolution of the developing roller, causing tailing and deteriorating the quality of the images. It is also preferred that the intrinsic coercive force (iHc) of the magnetic toner be 50 Oe or less for protecting against tailing and further improving the image quality. Since too low $\sigma_s$ makes the toner scatter from the developing roller, it is preferably 8 emu/g or more.

As the magnetic powder for forming the above magnetic toner, iron oxides such as magnetite and hematite may be used. In order to make $\sigma_s$ be within the range described above, the content of the magnetic powder is preferably within a range between 10 and 60% by weight.

The magnetic toner of the present invention contains the above magnetic powder and a fixing resin as essential components, but, as optional ingredients, known additives such as a fluidability reforming agent (inorganic fine particles such as hydrophobic silica and alumina), a charge control agent (nigrosine dyes, Cr-containing azo dyes, etc.), a releasing agent (polyalkylene etc.), and colorants (carbon black etc.) may also be included. The fixing resin may be selected suitably in accordance with the fixing method. In the case of heat roller fixing, the use of styrene or polyester resin is preferred. The above magnetic toner may be manufactured using the known methods such as grinding, spray drying, and suspension polymerization.

Using the above constitution, the scraping and recovering of remaining toner by the magnetic brush in the developing and cleaning regions are improved and also in the imaging method without requiring the process for cleaning the surface of the image media before the production of electrostatic latent images, remaining toner in the electrostatic latent image production section can be completely recovered, and clear, high-quality images can be obtained. Of course, the binary developer of the present invention may also be used in an imaging method in which the surface of the image medium before the production of electrostatic latent images.

DETAILED DESCRIPTION OF THE PREFERRED EMBODIMENTS

Mild steel scrap was primarily ground, oil-quenched, sorted, and nitrogen-treated to form brittle primary particles. The primary particles were ground and sorted to obtain iron particles having average diameters of 5 μm, 10 μm, 30 μm, 50 μm, 100 μm, and 120 μm. These iron particles were flat and polyhedral and had a volume resistivity of $4\times10^5$ Ω.cm These particles were used as the carrier for the developer.

As a comparative example, a carrier for the developer consisting of spherical iron particles was prepared using the following method: The above primary particles were denitrogenated after grinding, and, after the oxidation, reduction of the surface and being sorted, a spherical carrier for the developer having an average particle diameter of 30 μm was obtained. This carrier for the developer had a volume resistivity of $8\times10^5$ Ω.cm.

Next, a charged magnetic toner was prepared using the following formulation:

Styrene-n-butyl methacrylate (Mw=$21\times10^4$, Mn=$1.6\times10^4$): 50 parts by weight Magnetite (iHc=30 Oe): 45 parts by weight Polypropylene (Viscol 550P manufactured by Sanyo Kasei K. K.): 3 parts by weight Cr-containing azo dye (Bontron E-81 manufactured by Orient Chemical Industries, Ltd.): 2 parts by weight The above materials were kneaded using a kneader with heating rollers for 30 minutes, then cooled, pulverized, and classified to obtain a magnetic toner having an average particle diameter of 9 μm. The volume resistivity of this magnetic toner was $3\times10^{14}$ Ω.cm, the intrinsic coercive force (iHc) was 30 Oe, and the saturated magnetization ($\sigma_s$) was 36 emu/g.

The above volume resistivity was measured as follows: Several tens of milligrams of the samples to be measured were taken, packed in a Teflon(®) insulated cylinder having a diameter of 3.05 mm (cross-sectional area: 0.073 $cm^2$) modified from a dial gage, and a pressure of 0.1 kgf was applied. The volume resistivity was measured using an insulation resistance tester (Model 4329A) manufactured by Yokogawa-Hewlett-Packard K. K. in an electric field of 4000 V/cm DC for the magnetic toner, and in an electric field of 200 V/cm DC for the carrier for developer. The magnetic properties of the carrier and the magnetic toner were measured using a vibrated sample magnetometer (Model VSM- 3, manufactured by Toei Industry Co, Ltd.) in a magnetic field having a maximum of 10 k Oe.

The above carrier for developer was mixed with the magnetic toner to prepare a developer having a toner content of 30% by weight, and developed images were evaluated using the imaging equipment described below.

Figure 1:
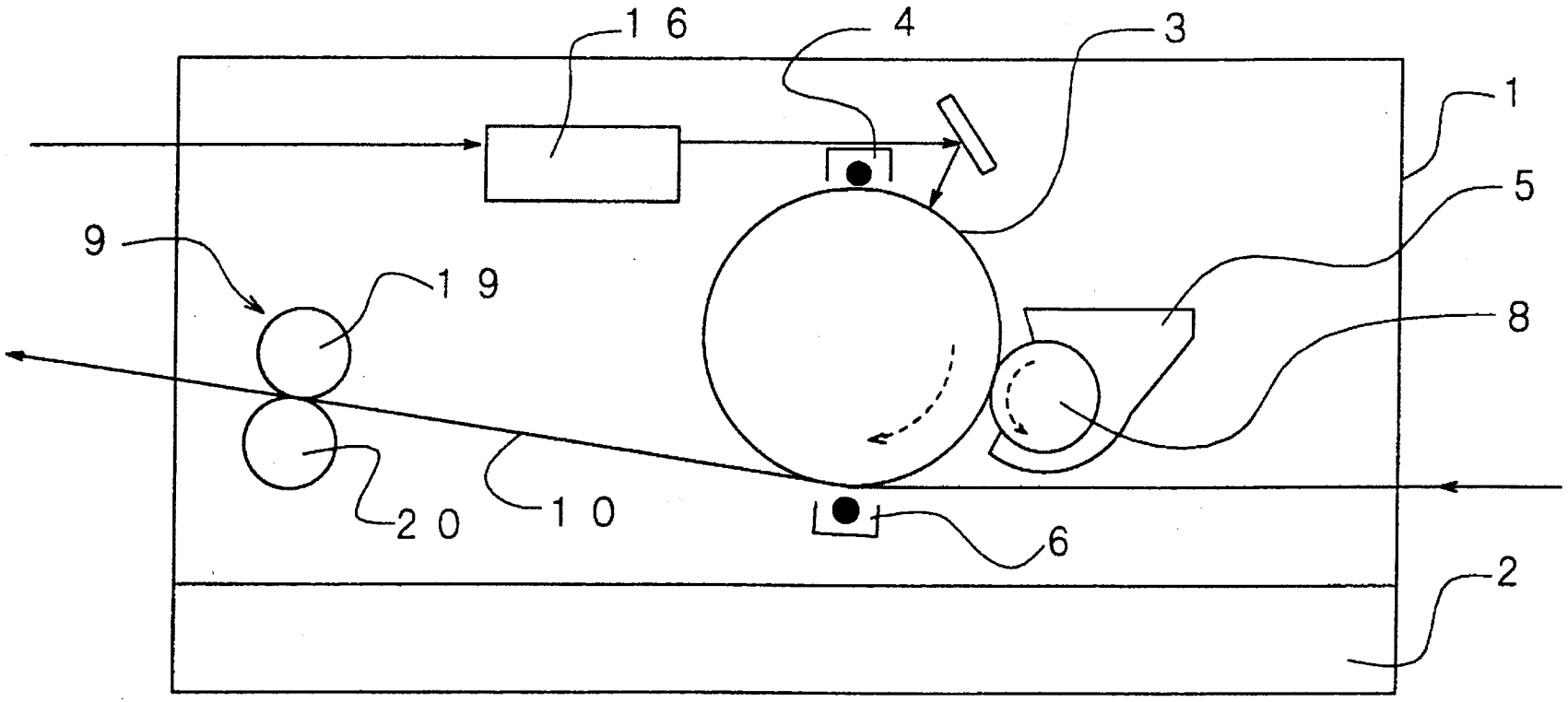
FIG. 1 is a schematic diagram showing the main section of the imaging means in an embodiment of the present invention.

FIG. 1 is a schematic diagram showing the main section of the apparatus in an embodiment of the present invention-In FIG. 1, the image forming unit 1 accommodates components described later, and is integrally installed on the control unit 2. The photosensitive drum 3 is cylindrical, provided with a photosensitive layer (not shown) such us zinc oxide or an organic semiconductor on the outer surface, and installed in the image forming unit 1 and rotatable in the direction of the arrow. Around the photosensitive drum 3 are a corona charger 4, a developing and cleaning device 5, and a corona transfer device 6 adjacently to each other. A magnet roller 8 is installed and rotatable in the developing and cleaning device 5 so that the magnet roller 8 faces the photosensitive drum 3.

A fixing device 9 is provided on the downstream portion of the recording paper feed path 10 in the image forming unit 1. The fixing device 9 consists of a heating roller 19 and pressure roller 20 arranged to revolve in pressure contact with each other. Each of the heating roller 19 and the pressure roller 20 has an outer diameter of 20 mm, and is made to contact each other under a linear pressure of 0.5 kg/cm. The heating roller 19 is fabricated, for example, from an aluminum alloy core having a heater consisting of an electric resistance material on the outer surface, covered with a releasing layer made of, for example, PTFE having a thickness of about 10 μm. The pressure roller 20 consists of the core of the similar material used in the heating roller 19, covered with an outer layer made of, for example, a silicone rubber.

In operation, each component in the image forming unit 1 is driven or activated through the control unit 2, and electrical signals corresponding to information or images are input from a laser scanner 16. The surface of the photosensitive drum 3 is then charged by the corona charger 4, and laser beams corresponding to the electric signals are irradiated on the charged surface to produce electrostatic latent images. These electrostatic latent images are developed into toner images by the magnetic developer attracted and conveyed by the magnet roller 8 installed in the developing and cleaning device 5, and transferred on a recording medium (e.g., plain paper) (not shown) moving along the recording medium feed path 10 by the corona transfer device 6. The magnetic toner remaining on the photosensitive drum 3 after transfer is removed from the photosensitive drum 3 by the developing and cleaning device 5 when the electrostatic latent images are developed using the magnetic brush on the magnet roller.

The recording medium carrying the toner images is then fed into the fixing device 9, heat from the heating roller 19 is propagated onto the toner images on the recording medium, and the finder resin contained in the magnetic toner melts to fix the images.

Figure 2:
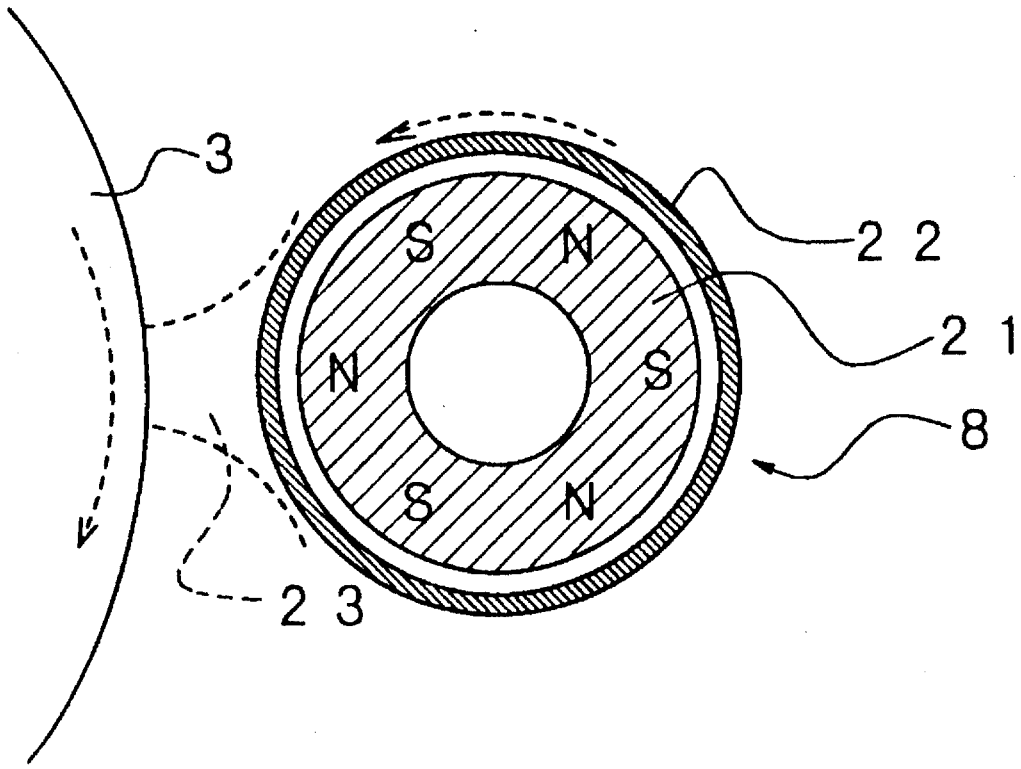
FIG. 2 is an enlarged cross-sectional view of the magnet roller in FIG. 1.

FIG. 2 is an enlarged cross-sectional view of the magnet roller 8 in FIG. 1. In FIG. 2, the magnet roller 8 is integrally formed into a cylindrical shape from a sintered magnet such as hard ferrite, or may consist of a permanent magnet (so-called plastic magnet) component 21 integrally formed into a cylindrical shape by a mixture of ferromagnetic powder and binder (resin), and a sleeve 22 formed from a non-magnetic material such as an aluminum alloy and austenitic stainless steel into a hollow cylindrical shape installed coaxially.

A plurality of magnetic poles extending in the axial direction is provided on the outer surface of the permanent magnet component 21, and a specific pole (e.g., an N-pole) is fixed to face the photosensitive drum 3. The sleeve 22 is fabricated so as to rotate around the permanent magnet component 21 counterclockwise, and attract the magnetic developer (not shown) and convey it to the photosensitive drum 3.

Using the above structure, a magnet brush 23 consisting of the magnet developer is formed by the magnetic pole N in the region where the magnet roller 8 and the photosensitive drum 3 face each other, and the magnet brush 23 rubs the surface of the photosensitive drum 3. Therefore, the magnetic toner remaining on the photosensitive drum 3 even after passing the corona transfer device 6 shown in FIG. 1 is removed and recovered by the developing and cleaning device 5, and, at the same time, the electrostatic latent image produced on the photosensitive drum 3 is developed by the magnetic brush 23 on the magnet roller 8. Thus, the magnetic toner in the magnetic developer is deposited on the electrostatic latent image, producing a visible toner image.

The results of imaging using a developer consisting of the mixture of the above iron powder carrier and the triboelectric charge type magnetic toner by the imaging unit 1 shown in FIG. 1 will be described next. First, the photosensitive drum 3 is uniformly charged at −550 V by the corona charger 4, and is rotated in the direction of the arrow at a surface speed of 60 mm/s.

The magnet roller 8 constituting the developing and cleaning device 5 has a austenitic stainless steel (SUS 304) sleeve having an outer diameter of 20 mm, and rotates in the arrow direction at 150 rpm. The permanent magnet component 21 shown in FIG. 2 has six magnetic poles, and the surface magnetic flux density is 750 G. A bias voltage of −450 V was applied to the sleeve 22, and the doctor gap and the developing gap were set to be 0.2 mm and 0.3 mm, respectively. Fixing with the heat roller after transfer was performed at a temperature of 180° C. and a linear pressure of 1 kgf/cm.

Table 1 shows the result of imaging using the developer prepared as described above under the ambient conditions of a temperature of 20° C. and a relative humidity of 60%.

TABLE 1

| Type of example | No | Average particle diameter of carrier (μm) | Image density | Resolution (line/mm) | Tailing | Fogging | Carrier deposition |
|---|---|---|---|---|---|---|---|
| Embodiment | 1 | 5 | 1.42 | 10 | good | No | No |
| | 2 | 10 | 1.40 | 10 | good | No | No |
| | 3 | 30 | 1.40 | 10 | good | No | No |
| | 4 | 50 | 1.38 | 10 | good | No | No |

TABLE 1-continued

| Type of example | No | Average particle diameter of carrier (μm) | Image density | Resolution (line/mm) | Tailing | Fogging | Carrier deposition |
|---|---|---|---|---|---|---|---|
| | 5 | 100 | 1.41 | 8 | good | No | No |
| | 6 | 120 | 1.32 | 8 | good | No | Scratch on the drum |
| Comparative example | 7 | 30 | 1.28 | 10 | good | Yes | Yes |

As Table 1 shows, when, on the one hand, a spherical carrier as shown in the comparative example (No. 7) was used, the image density was slightly low, and fogging and carrier deposition occurred. When nonspherical carriers as shown in the embodiment (Nos. 1–6) were used, on the other hand, high-quality images having high image densities and high resolution were obtained without tailing, fogging, or carrier deposition. Even when nonspherical carrier was used, if the average particle diameter exceeds 100 μm (No. 6), the drum was scratched. The average particle diameter of the carrier should, therefore, be 100 μm or less, and preferably 50 μm or less from the point of view of resolution.

Next, magnetic toners were prepared in which the type and content of magnetic powder contained in the magnetic toners were changed as shown in Table 2. The results of imaging under the same conditions as described above are also shown in Table 2. The carrier used was No. 3 (average particle diameter: 30 μm) shown in Table 1.

TABLE 2

| Type of example | No | Magnetic powder | Magnetic properties iHc (Oe) | Magnetic properties δs (emu/g) | Image density | Resolution (line/mm) | Tailing | Fogging | Carrier deposition |
|---|---|---|---|---|---|---|---|---|---|
| Embodiment | 8 | Ba—Ni—Zn Ferrite40 | 15 | 32 | 1.45 | 10 | No | No | No |
| | 9 | Magnetite 40 | 50 | 35 | 1.41 | 10 | No | No | No |
| Comparative example | 10 | Ba—Ni—Zn Ferrite45 | 80 | 40 | 1.39 | 10 | Little | No | No |
| | 11 | Magnetite 75 | 30 | 60 | 1.15 | 10 | Yes | No | No |

As Table 2 shows, tailing occurred if the coercive force and saturated magnetization of the magnetic toner were large (Nos. 10 and 11), but no tailing, fogging, or carrier deposition occurred and high-quality images having high image density and high resolution were obtained when the coercive force was 50 Oe or below and the saturated magnetization was 50 emu/g or below (Nos. 8 and 9).

For each embodiment, 50,000 image sheets were continuously produced under the same conditions as described above, and the fluctuation of image densities was found to be 0.2, which caused no practical problems. It was also confirmed that images without practical problems were obtained under ambient conditions consisting of high temperature (30° C.) and high humidity (80% RH) and low temperature (10° C.) and low humidity (30% RH).

Although the toner content in the mixture of the carrier for developers and the magnetic toner is 30% by weight in the above embodiments, the toner content may be in a range between 10 and 90% by weight, preferably between 10 and 40% by weight.

Since the present invention has the constitution and function as described above, image quality is improved and carrier scattering is prevented by the use of a carrier having a small particle diameter and nonspherical shape. The function of scraping and recovering remaining toner by the magnetic brush in the developing and cleaning region is improved, and, even in imaging without the cleaning means or cleaning process for the surface of the image media, the remaining toner can be recovered completely.

By the use of a magnetic toner having a relatively low magnetic force, the occurrence of tailing due to the movement of the magnetic toner on the image produced on the image medium is prevented. Therefore, the present invention is effective for obtaining clear and high-quality images.

What is claimed is:

1. A binary developer comprising a mixture of a carrier consisting of nonspherically formed magnetic particles, the magnetic particles having an average diameter of 5 to 100 μm, and a magnetic toner having an average particle diameter of 10 μm or below, wherein the magnetic toner comprises a fixing resin and 10 saturation magnetization ($\sigma_s$) of 50 emu/g or less, and wherein to 60 wt. % of a magnetic powder, and has a the mixture consists of 10 to 90 wt. % of the magnetic toner.

2. A binary developer as set forth in claim 1, in which the intrinsic coercive force of the magnetic toner (iHc) is 50 Oe or less.

3. A binary developer as set forth in claim 1, in which the saturated magnetization of magnetic particles composing the magnetic carrier ($\sigma_s$) is 60 emu/g or above.

4. A binary developer as set forth in claim 1, in which the surface of magnetic particles composing the magnetic carrier is coated with a resin material.

5. A binary developer as set forth in claim 1, wherein the average diameter of the nonspherically formed magnetic particles of the magnetic carrier is 5 to 50 μm.

* * * * *

UNITED STATES PATENT AND TRADEMARK OFFICE

CERTIFICATE OF CORRECTION

PATENT NO. : 5,516,613

DATED : May 14, 1996

INVENTOR(S) : Masumi ASANAE et al.

It is certified that error appears in the above-indentified patent and that said Letters Patent is hereby corrected as shown below:

Claim 1, column 8, lines 48-50, change "10 saturation magnetization ($\sigma_s$)of 50 emu/g or less, and wherein to 60 wt. % of a magnetic powder, and has a the" to –10 to 60 wt. % of a magnetic powder, and has a saturation magnetization ($\sigma_s$) of 50 emu/g or less, and wherein the–.

Signed and Sealed this

Sixteenth Day of July, 1996

*Attest:*

*Attesting Officer*

BRUCE LEHMAN

*Commissioner of Patents and Trademarks*